US007055346B2

(12) United States Patent
Lonati et al.

(10) Patent No.: US 7,055,346 B2
(45) Date of Patent: Jun. 6, 2006

(54) CIRCULAR KNITTING MACHINE FOR HOSIERY OR THE LIKE, WITH DEVICE FOR ACTUATING THE KNOCKOVER SINKERS

(75) Inventors: Ettore Lonati, Brescia (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 10/514,468

(22) PCT Filed: May 5, 2003

(86) PCT No.: PCT/EP03/04682

§ 371 (c)(1),
(2), (4) Date: Nov. 15, 2004

(87) PCT Pub. No.: WO03/100147

PCT Pub. Date: Dec. 4, 2003

(65) Prior Publication Data

US 2005/0183462 A1 Aug. 25, 2005

(30) Foreign Application Priority Data

May 23, 2002 (IT) ..... MI2002A1116

(51) Int. Cl.
*D04B 15/34* (2006.01)

(52) U.S. Cl. ..... 66/108 R

(58) Field of Classification Search ..... 66/107, 66/108 R, 115, 104
See application file for complete search history.

(56) References Cited

U.S. PATENT DOCUMENTS

| | | | | |
|---|---|---|---|---|
| 3,318,113 A | | 5/1967 | Nebel | |
| 3,783,645 A | * | 1/1974 | Bianchi | 66/108 R |
| 4,156,356 A | * | 5/1979 | Holder | 66/108 R |
| 4,571,957 A | * | 2/1986 | Engelfried et al. | 66/115 |

FOREIGN PATENT DOCUMENTS

| | | |
|---|---|---|
| DE | A-28 56 602 | 7/1980 |
| EP | A-0 281 168 | 9/1988 |
| EP | A-0 454 023 | 10/1991 |

* cited by examiner

*Primary Examiner*—Danny Worrell
(74) *Attorney, Agent, or Firm*—Modiano & Associati; Albert Josif; Daniel O'Byrne

(57) ABSTRACT

A circular knitting machine for hosiery or the like, with a device for actuating the knockover sinkers, comprising a sinker cover, arranged in an upward region and coaxially to the sinker ring and supporting at least one cam and one complementary cam arranged outside the cam with respect to the cylinder axis, the cam and the complementary cam forming path portions running around the cylinder axis engageable by a heel of the knockover sinkers to actuate movement thereof along a radial direction, a first actuation varying angular position of the sinker cover, and a second actuation varying movement of the complementary cam.

24 Claims, 5 Drawing Sheets

CIRCULAR KNITTING MACHINE FOR HOSIERY OR THE LIKE, WITH DEVICE FOR ACTUATING THE KNOCKOVER SINKERS

The present invention relates to a circular knitting machine for hosiery or the like, with device for actuating the knockover sinkers.

BACKGROUND OF THE INVENTION

As is known, circular hosiery knitting machines, particularly single-cylinder circular machines, have knockover sinkers located inside radial slots of an appropriately provided support known as sinker ring, which is monolithically associated with the needle cylinder proximate to its upper end.

The knockover sinkers are staggered with respect to the needles, so that each sinker lies between two contiguous needles, and are actuated, during the rotation of the needle cylinder about its own axis, with a reciprocating motion along a radial direction with respect to the needle cylinder.

More particularly, the knockover sinkers are moved away from the axis of the needle cylinder when the needles, after engaging the thread, start their descent to form new loops of knitting, so that the region of the thread or threads between two contiguous loops rests on the upper portion of the sinkers, which is usually flat and known as knockover plane, while the loops formed previously are knocked over, i.e., released by the corresponding needle. After knocking over the old loops, while the needles start a new upward motion, the sinkers are moved toward the axis of the needle cylinder in order to engage the new loops by means of a hook that lies above the knockover plane, so as to retain and tension the loops against the shank of the needles. This retention against the shank of the needles also has the effect of assuredly opening the latch located proximate to the hook of the needles, while the tensioning, particularly after forming the new loop, shapes the part of said loop produced by the sinker.

The movement of the knockover sinkers along a radial direction with respect to the needle cylinder toward and away from the axis of said needle cylinder is achieved by means of an annular cam, which lies around the axis of the needle cylinder. The movement toward the axis of the needle cylinder, particularly after forming the new loop, is assisted by a complementary cam, and said cam and complementary cam are associated with a sinker cover which lies above the sinker ring and is supported by the supporting structure of the machine.

At least one complementary cam for each feed or drop of the machine is generally provided.

The annular cam and the complementary cams lie around the axis of the needle cylinder and trace a path with portions that move toward the axis of the needle cylinder and portions that move away from it; said path is engaged by a heel of the sinkers, which protrudes upward from the sinker ring, when the needle cylinder is actuated so as to rotate about its own axis with respect to the supporting structure of the machine and therefore with respect to the cover of the sinkers.

In the production of knitted articles it is necessary to be able to advance or delay the movement of the sinkers and to vary the extent of the movement of the sinkers away from the axis of the needle cylinder, in order to be able to obtain high-quality articles by perfectly balancing the part of the loop that is formed by the needle, which can vary in the row, with the part of loop that is formed by the sinker.

To meet these requirements, the cover of the sinkers is supported so that it can rotate about the axis of the needle cylinder, and the complementary cams can move with respect to the sinker cover toward or away from the axis of the needle cylinder; there are also first actuation means, which act on the sinker cover in order to turn it about the axis of the needle cylinder through a preset angle, and second actuation means, which act on command on the complementary cams in order to vary their position with respect to the sinker cover along a radial direction with respect to the axis of the needle cylinder.

In many modern hosiery knitting machines, the first actuation means and the second actuation means are constituted by a first step motor and by a second step motor, which are respectively connected to the sinker cover and to the complementary cams by way of a gear transmission.

The first step motor is usually supported by a fixed structure, while the second step motor is generally mounted on the sinker cover.

However, the gear transmission causes problems and drawbacks.

More particularly, the adoption of a gear transmission, which allows to have an adequately low contrast torque on the motor shaft, requires a relatively large number of components, with consequent production costs.

Moreover, the plays in the meshing of the teeth of the various gears causes instability in the angular position of the sinker cover around the axis of the needle cylinder.

The mounting of the step motor for varying the position of the complementary cams on the sinker cover causes an imbalance and instability of said cover that can cause work defects and poor product quality.

SUMMARY OF THE INVENTION

The aim of the present invention is to solve the problems mentioned above, by providing a circular knitting machine for hosiery or the like, with a device for actuating the knockover sinkers, that allows to achieve high precision in adjusting the angular position of the sinker cover and/or the movement of the complementary cams along a radial direction with respect to the axis of the needle cylinder.

Within this aim, an object of the invention is to provide a device for actuating the knockover sinkers that can be produced with a reduced number of components.

Another object of the invention is to provide a device for actuating the knockover sinkers that has high precision and stability in operation.

This aim and these and other objects that will become better apparent hereinafter, are achieved by a circular knitting machine for hosiery or the like, with a device for actuating the knockover sinkers, comprising:

a needle cylinder, arranged so that its axis is substantially vertical and can be actuated so as to rotate about said axis;

a sinker ring, rigidly coupled to said needle cylinder in rotation about its axis and arranged coaxially to the needle cylinder proximate to its upper end, said sinker ring supporting a plurality of knockover sinkers, which can move radially with respect to the needle cylinder and the sinker ring;

a sinker cover, arranged in an upward region and coaxially with respect to said sinker ring and supporting at least one cam and at least one complementary cam, which is arranged outside said cam with respect to the axis of the needle cylinder; said cam and said complementary cam forming portions of a path that runs around the axis of the needle cylinder and can be engaged by a heel of the knockover sinkers in order to actuate the movement of the knockover sinkers along a radial direction with respect to the needle cylinder when the needle cylinder rotates about its own axis with respect to said sinker cover, said cam and said complementary cam, said complementary cam being movable with respect to said sinker cover along a direction that is substantially radial to the axis of the needle cylinder;

first actuation means, acting on said sinker cover to turn it about the axis of the needle cylinder;

second actuation means, adapted to vary the extent of the movement of said complementary cam along said substantially radial direction with respect to said axis of the needle cylinder;

characterized in that said first actuation means and/or said second actuation means comprise an electric motor, which is connected to said sinker cover and/or to said at least one complementary cam by way of a cam transmission.

BRIEF DESCRIPTION OF THE DRAWINGS

Further characteristics and advantages of the invention will become better apparent from the description of an embodiment of the machine with device for actuating the knockover sinkers according to the invention, illustrated only by way of non-limitative example in the accompanying drawings, wherein.

DESCRIPTION OF THE PREFERRED EMBODIMENTS

Figure 1:
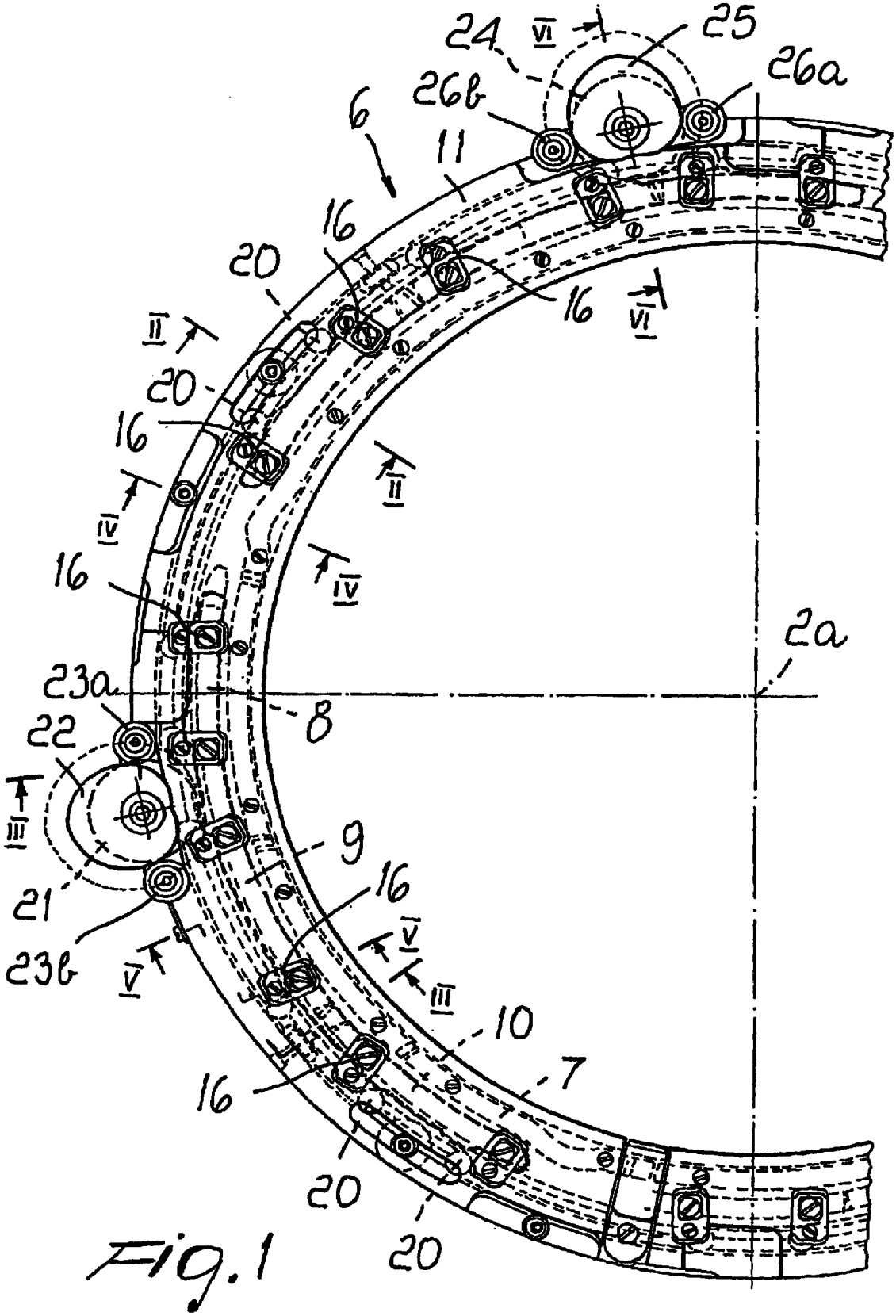
FIG. 1 is a schematic top plan view of a portion of the sinker ring.

With reference to the figures, the circular machine with device for actuating the knockover sinkers comprises, in a per se known manner, a needle cylinder, which is arranged so that its axis 2*a* is substantially vertical and can be actuated with a rotary motion about said axis 2*a* with respect to the supporting structure of the machine.

The machine comprises a sinker ring 3, which is fixed coaxially to the needle cylinder proximate to its upper end. The sinker ring 3 is monolithically coupled to the needle cylinder in its rotation about its axis 2*a* with respect to the supporting structure of the machine.

The sinker ring 3 has, in a per se known manner, a plurality of radial slots 4, which are open upward; each slot accommodates a knockover sinker 5, which can slide radially with respect to the needle cylinder inside the corresponding slot 4. Each knockover sinker 5 has a heel 5*a*, which protrudes upward from the corresponding slot 4, and above the sinker ring 3 there is a sinker cover 6, which is arranged coaxially to the sinker ring 3 and supports at least one cam 7 and at least one complementary cam, which is arranged externally with respect to the cam 7 relative to the axis 2*a* of the needle cylinder.

In the illustrated embodiment, which relates to a circular knitting machine with four feeds, there is a single annular cam 7 and there are three complementary cams 8, 9 and 10 for each feed of the machine; said cams are substantially shaped like annular sectors.

The cam 7 and the complementary cams 8–10 form portions of a path that lies around the axis 2*a* of the needle cylinder and can be engaged by the heel 5*a* of the knockover sinkers 5 in order to actuate the movement of the knockover sinkers 5 along a radial direction with respect to the axis 2*a* of the needle cylinder when the needle cylinder rotates about its own axis 2*a* with respect to the sinker cover 6, the cam 7 and the complementary cams 8–10.

The machine further comprises first actuation means, which act on the sinker cover 6 to produce, when required, its rotation about the axis 2*a* of the needle cylinder, and second actuation means, which are adapted to vary the extent of the movement of the complementary cams 8–10 along a radial direction with respect to the axis 2*a*.

More particularly, the sinker cover 6 is substantially composed of an upper ring 11 and a lower ring 12, whose axes coincide with the axis 2*a*.

Figure 2:
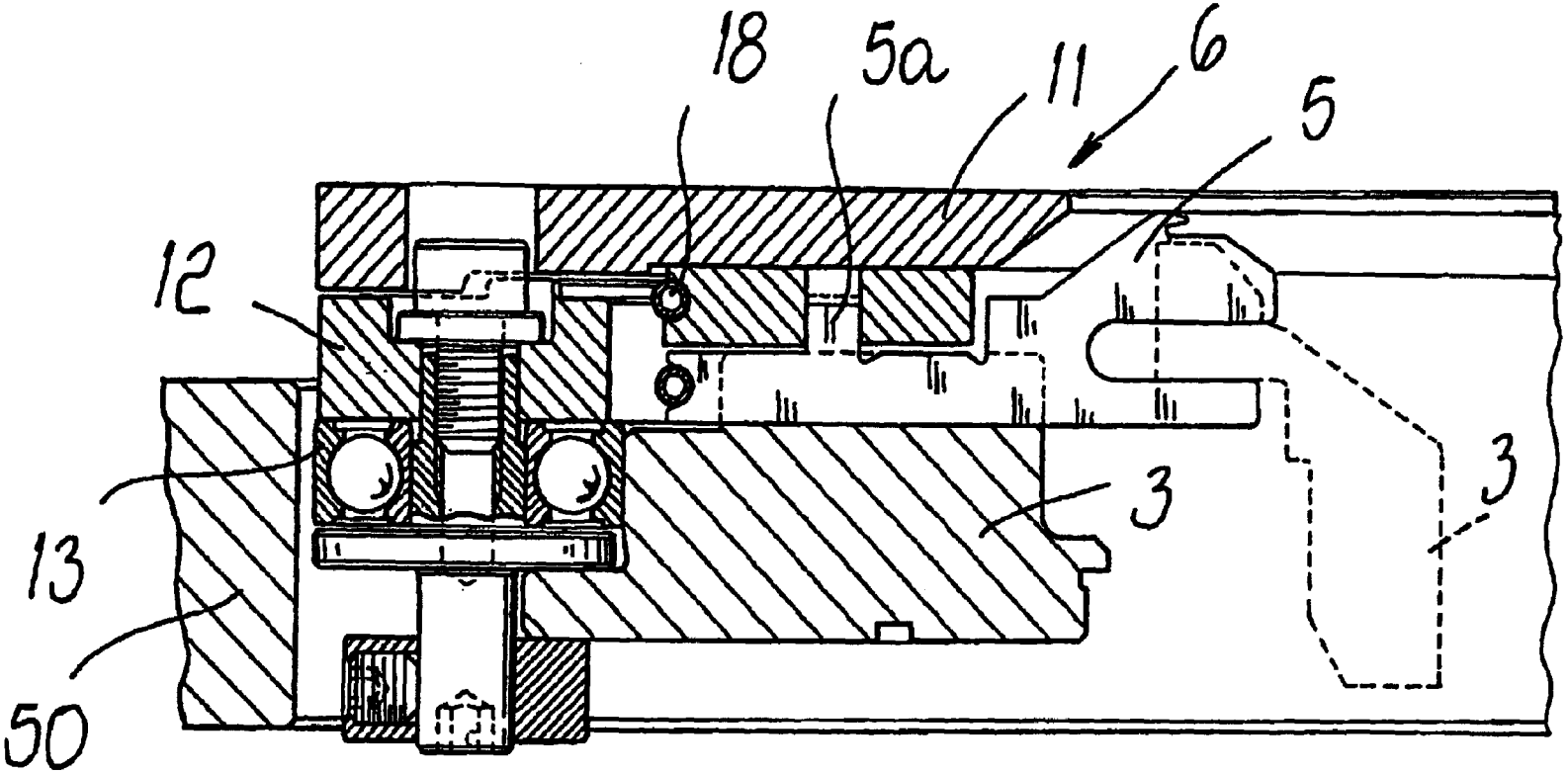
FIG. 2 is an enlarged-scale sectional view of FIG. 1, taken along the line II—II.

The lower ring 12 is locked axially and radially on the sinker ring 3, as shown in particular in FIG. 2, but can rotate with respect to said ring about the axis 2*a*. To allow and facilitate this rotation, bearings 13 are interposed between the lower ring 12 and the sinker ring 3.

Figure 3:
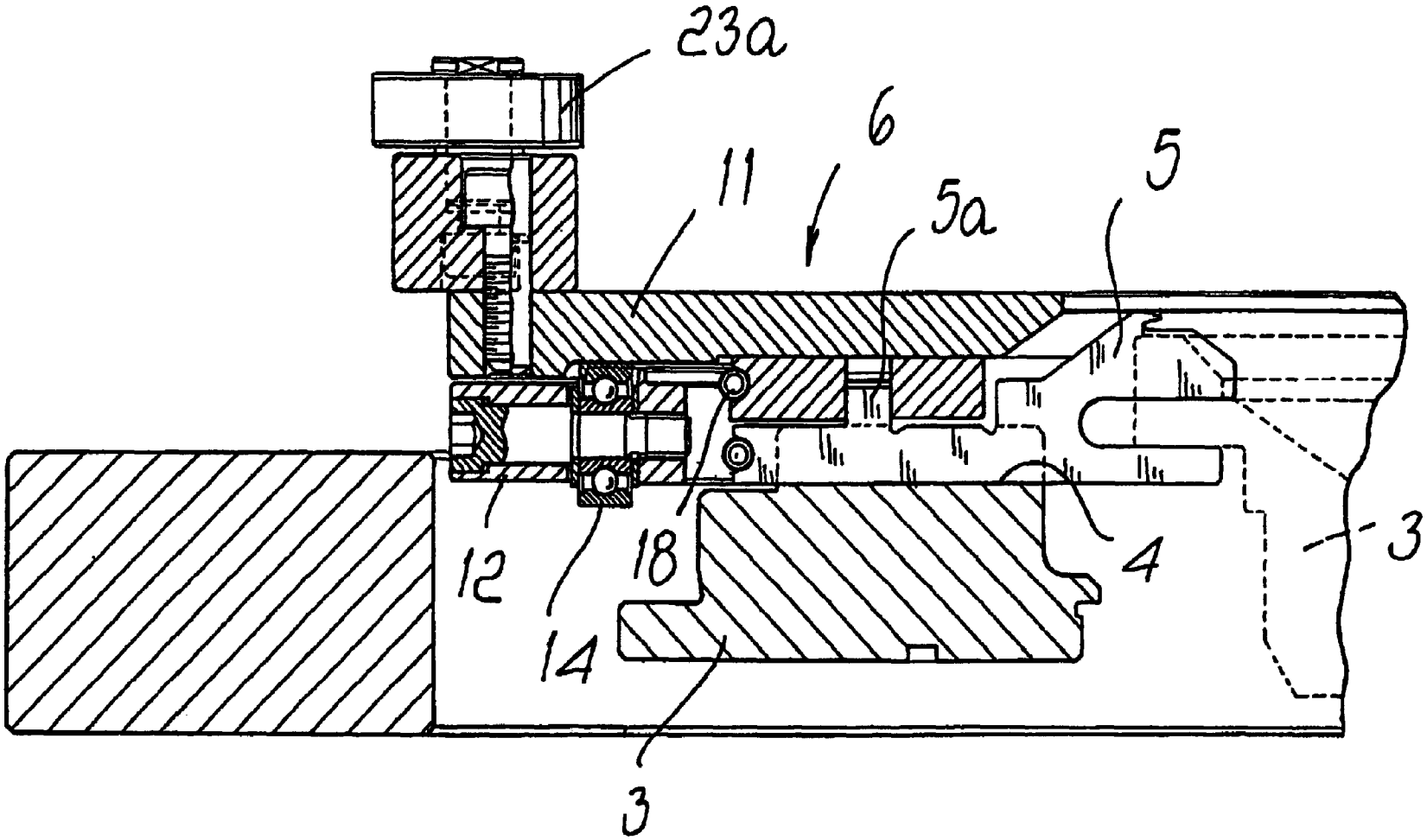
FIG. 3 is an enlarged-scale sectional view of FIG. 1, taken along the line III—III.
Figure 5:
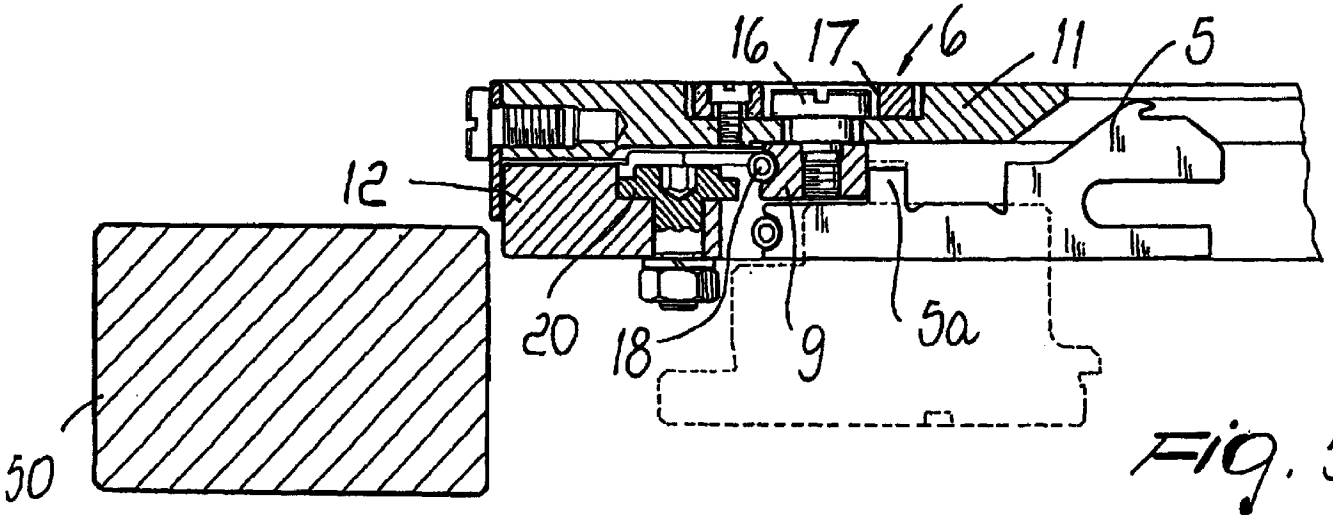
FIG. 5 is an enlarged-scale sectional view of FIG. 1, taken along the line V—V.
Figure 4:
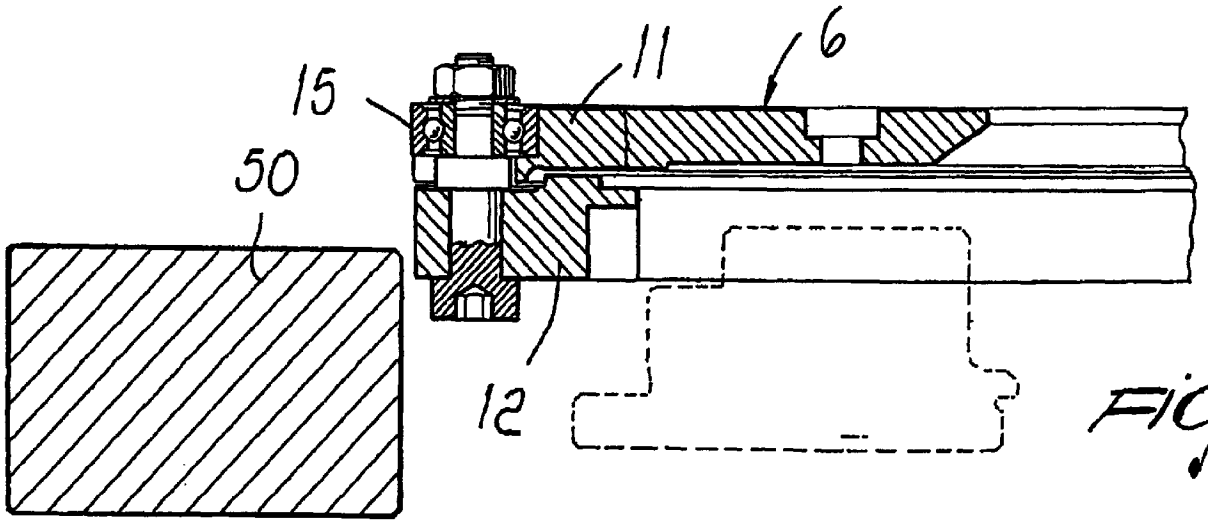
FIG. 4 is an enlarged-scale sectional view of FIG. 1, taken along the line IV—IV, with some details omitted for the sake of simplicity.

The upper ring 11 is supported by the lower ring 12, so as to allow rotation about the axis 2*a*, by way of bearings 14, as shown in FIG. 3. Furthermore, the upper ring 11 is locked axially and radially on the lower ring 12, as shown in particular in FIG. 4, which shows that there are additional bearings 15 between the upper ring 11 and the lower ring 12.

The cam 7 can be provided monolithically and be fixed to the lower face of the upper ring 11, or can be formed by a number of parts connected to the lower face of the upper ring 11, with an annular shape provided with the typical contoured regions proximate to the feeds or drops of the machine in order to produce the required movement of the sinkers toward and away from the axis 2*a* of the needle cylinder.

The complementary cams 8–10 also are connected to the lower face of the upper ring 11, but are fixed to screws 16, which are slidingly coupled to appropriate slots 17 formed in the upper ring 11, so as to be able to move along a radial direction with respect to the axis 2*a*.

Preferably, the movement of the complementary cams 8–10 away from the axis 2*a* is contrasted by elastic means, which in the illustrated embodiment are constituted by an annular spring 18, which is arranged in a circular fashion around the axis 2*a* and surrounds all of the complementary cams 8–10.

The lower ring 12 supports roller-shaped locators 20, which face the opposite side of the complementary cams 8–10 with respect to the cam 7 and are designed to limit the movement of the complementary cams 8–10 away from the cam 7 due to the force that the knitted fabric discharges onto the sinkers 5, overcoming the elastic reaction of the annular spring 18.

The side of the complementary cams 8–10 that is designed to engage the locators 20 is conveniently provided with a contoured profile so as to vary the distance between the locators 20 and the complementary cams 8–10 when the angular position of the lower ring 12 around the axis 2*a* changes with respect to the upper ring 11.

The first actuation means comprise a first electric motor 21, preferably a step motor, which is supported by a fixed structure 50 and is provided with an output shaft that is orientated so that its axis is parallel to the axis 2*a* and on which a first actuation cam 22 is keyed; said actuation cam is coupled to at least one cam follower, which is connected to the upper ring 11.

Preferably, there are two cam followers 23*a* and 23*b*, constituted by rollers or bearings, which are connected to the upper ring 11 and are arranged so as to provide a bilateral coupling to the first actuation cam 22; said coupling can optionally be preloaded.

The second actuation means comprise a second electric motor, preferably a step motor, designated by the reference numeral 24, which is also conveniently supported by a fixed structure 50 and is provided with an output shaft, which is orientated so that its axis is parallel to the axis 2*a* and on which a second actuation cam 25 is keyed; said second actuation cam is coupled to at least one cam follower connected to the lower ring 12.

Preferably, in this case also, there are two cam followers 26*a* and 26*b*, constituted by rollers or bearings, which are connected to the lower ring 12 and are arranged so as to provide a bilateral coupling to the second actuation cam 25; said coupling can optionally be preloaded.

The portions of the profile of the actuation cams 22 and 25 that correspond to the work angle of the actuation cams are complementary, so as to allow a transmission of motion from the actuation cams 22 and 25 to the upper ring 11 and to the lower ring 12 that is practically free from play.

Moreover, the profile of the actuation cams 22 and 25 is preferably provided so as to establish a linear relationship between the rotation of the actuation cams 22 and 25 and the rotation of the upper ring 11 and of the lower ring 12 respectively. This refinement allows to simplify the programs for actuating and controlling the rotation of the upper ring 11 and of the lower ring 12.

Conveniently, sensing means are provided for sensing the rotation of the upper ring 11 and of the lower ring 12 about the axis 2*a*.

Figure 6:
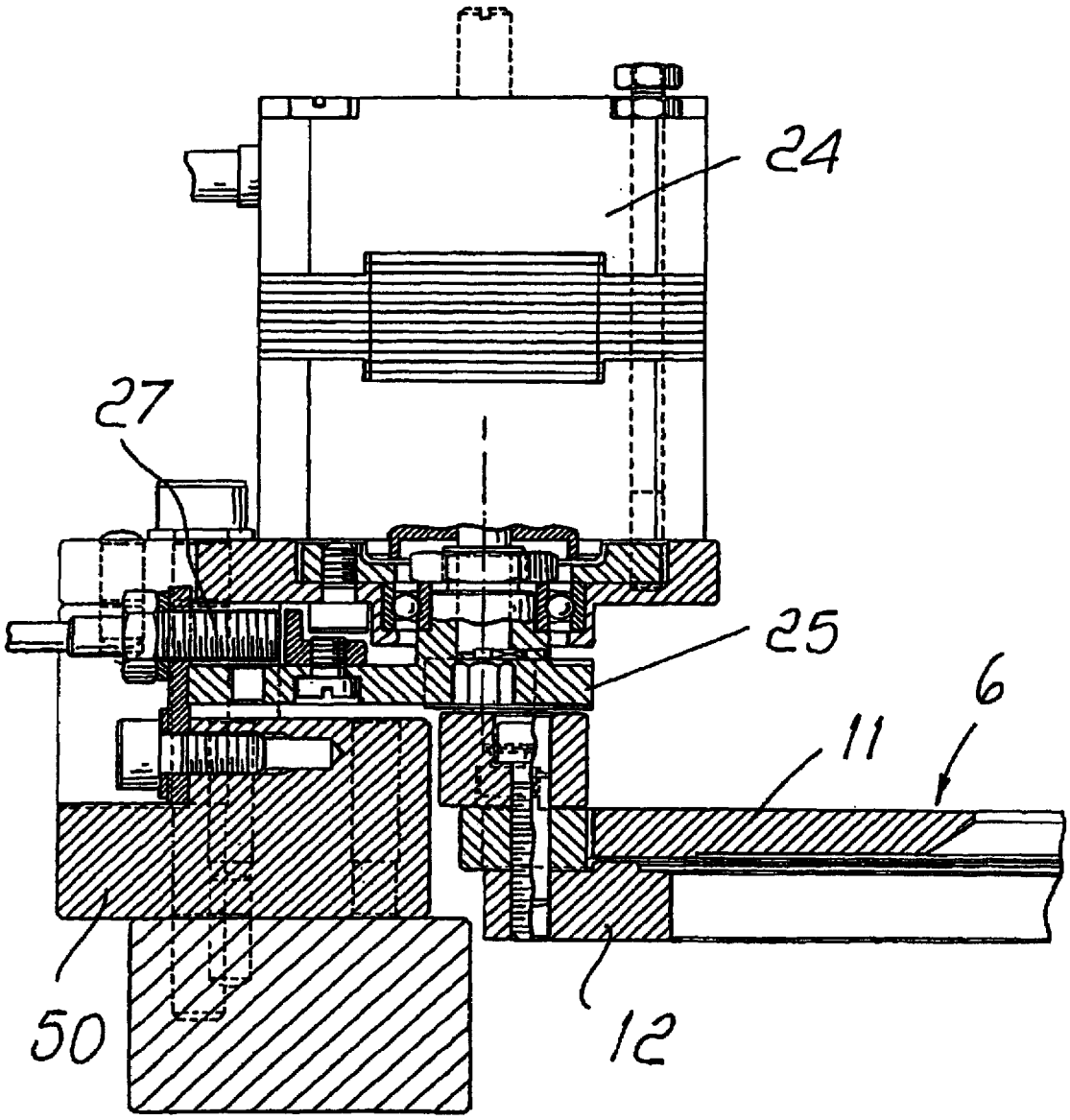
FIG. 6 is an enlarged-scale sectional view of FIG. 1, taken along the line VI—VI.

Said sensing means can be constituted by known kinds of sensor, such as for example encoders, for detecting the angular position of the actuation cams 22 and 25, or the angular position of the rings 11 and 12 about the respective rotation axes. FIG. 6 illustrates, merely by way of example, a sensor 27 for controlling the rotation of the second actuation cam 25.

Operation of the machine as regards the sinker actuation device is as follows.

The actuation of the needle cylinder about its own axis 2*a* and therefore about the sinker ring 5 causes the heel 5*a* of the sinkers 5 to follow the path determined by the cam 7 and by the complementary cams 8–10. The shape of this path causes, or allows, a movement of the sinkers 5 toward or away from the axis 2*a* in order to meet the various work requirements.

When one wishes solely to advance or delay the movement of the sinkers 5 with respect to the feeds or drops of the machine, both the first step motor 21 and the second step motor 24 are actuated; by means of the first actuation cam 22 and the second actuation cam 25, said motors cause the mutually rigid rotation of the upper ring 11 and of the lower ring 12 about the axis 2*a* of the needle cylinder through a preset angle.

When instead one wishes to vary only the extent of the movement away from the axis 2*a* allowed to the sinkers 5 by the complementary cams 8–10, the second step motor 24 is actuated; said motor, by causing the rotation of the second actuation cam 25, moves the locators 20 toward or away from the complementary cams 8–10.

In practice it has been found that the device according to the invention fully achieves the intended aim, since it allows to obtain, with a reduced number of components, high precision in adjusting the angular position of the sinker cover and/or the position of the complementary cams along a radial direction with respect to the axis of the needle cylinder.

Another advantage, which arises from the adoption of a cam transmission instead of a gear transmission, is that it is possible to use the motors that actuate said cams with a lower rotation rate and therefore in a more advantageous region of their characteristic curve in which the available torque is higher for equal dimensions.

The machine with the device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2002A001116 from which this application claims priority are incorporated herein by reference.

What is claimed is:

1. A circular knitting machine for hosiery, with a device for actuating the knockover sinkers, comprising:

a needle cylinder, arranged with an axis thereof substantially vertical, said needle cylinder being actuatable so as to rotate about said axis;

a sinker ring, rigidly coupled to said needle cylinder in rotation about said axis and arranged coaxially to the needle cylinder proximate to an upper end thereof, said sinker ring being provided with a plurality of knockover sinkers supported thereat, which are radially movable with respect to the needle cylinder and the sinker ring;

a sinker cover composed of an upper ring and a lower ring and arranged in an upward region and coaxially with respect to said sinker ring with supporting thereat at least one cam and at least one complementary can, which is arranged outside said at least one cam with respect to the axis of the needle cylinder; said at least one cam and said complementary cam forming portions of a path that runs round the axis of the needle cylinder and is engageable by a heel of the knockover sinkers in order to actuate movement of the knockover sinkers along a radial direction with respect to the needle cylinder when the needle cylinder rotates about said axis with respect to said sinker cover, said at least one cam and said complementary cam, said complementary cam being movable with respect to said sinker cover along a direction that is substantially radial to the axis of the needle cylinder;

first actuation means, acting on said sinker cover to turn the sinker cover about said axis of the needle cylinder;

second actuation means, adapted to vary a movement extent of said complementary cam along said substantially radial direction with respect to said axis of the needle cylinder; wherein said first actuation means comprises a first electric motor which is supported by a fixed structure and is provided with an output shaft to which a first actuation cam is keyed, said actuation cam being coupled to a pair of cam followers, which are connected to said upper ring of the sinker cover and are arranged so as to provide a bilateral and preloadable coupling with a profile of said first actuation cam.

2. The machine according to claim 1, wherein said upper ring supports said cam and said at least one complementary cam; said complementary cam being movable with respect to said upper ring along said substantially radial direction with respect to the axis of the needle cylinder; said lower ring being arranged in a downward region and coaxially with respect to said upper ring and having locators supported thereon, which face an opposite side of said complementary cam that is opposite with respect to a side that can engage the heel of the sinkers and are adapted to limit the movement of said complementary cam along said radial direction away from the axis of the needle cylinder.

3. The machine according to claim 1, comprising elastic means that contrast movement of said complementary cam away from the axis of the needle cylinder.

4. The machine according to claim 2, wherein said complementary cam has, on said opposite side thereof a profile that can engage said locators and is shaped so as to vary a distance of said profile from said locators when an angular position of said lower ring with respect to said upper ring varies.

5. The machine according to claim 2, wherein said second actuation means comprise a second electric motor, which is supported by a fixed structure and is provided with an output shaft with a second actuation cam keyed thereon, said second actuation cam having coupled thereto at least one cam follower which is connected to said lower ring of the sinker cover.

6. The machine according to claim 5, comprising a pair of cam followers, which are connected to said lower ring to which said second actuation cam is coupled, said pair of cam followers being arranged so as to provide a bilateral and preloadable coupling to the profile of said second actuation cam.

7. The machine according to claim 6, wherein said first actuation cam and/or said second actuation cam are provided so as to rotate about an axis that is parallel to the axis of the needle cylinder.

8. The machine according to claim 7, wherein profile portions of said first actuation cam and/or of said second actuation cam are shaped complementarily and are coupled, respectively, to said pairs of cam followers.

9. The machine according to claim 5, wherein said first and second electric motor of the actuation means is constituted by a step motor.

10. The machine according to claim 8, comprising sensing means for sensing rotation of said first actuation cam and/or of said second actuation cam about axis thereof.

11. The machine according to claim 10, comprising sensing means for sensing rotation of said upper ring and/or of said lower ring of the sinker cover about the axis of the needle cylinder.

12. The machine according to claim 8, wherein the profile of said first actuation cam and/or of said second actuation cam is shaped so as to determine a linear relationship between a rotation of said first actuation cam and a rotation of said upper ring of the sinker cover and/or between a rotation of said second actuation cam and a rotation of said lower ring of the sinker cover.

13. A circular knitting machine for hosiery, with a device for actuating the knockover sinkers, comprising:

a needle cylinder, arranged with an axis thereof substantially vertical, said needle cylinder being actuatable so as to rotate about said axis;

a sinker ring, rigidly coupled to said needle cylinder in rotation about said axis and arranged coaxially to the needle cylinder proximate to an upper end thereof, said sinker ring being provided with a plurality of knockover sinkers supported thereat, which are radially movable with respect to the needle cylinder and the sinker ring;

a sinker cover composed of an upper ring and a lower ring and arranged in an upward region and coaxially with respect to said sinker ring with supporting thereat at least one cam and at least one complementary cam, which is arranged outside said at least one cam with respect to the axis of the needle cylinder; said at least one cam and said complementary cam forming portions of a path that runs around the axis of the needle cylinder and is engageable by a heel of the knockover sinkers in order to actuate movement of the knockover sinkers along a radial direction with respect to the needle cylinder when the needle cylinder rotates about said axis with respect to said sinker cover, said at least one cam and said complementary cam, said complementary cam being movable with respect to said sinker cover along a direction that is substantially radial to the axis of the needle cylinder;

first actuation means, acting on said sinker cover to turn the sinker cover about said axis of the needle cylinder;

second actuation means, adapted to vary a movement extent of said complementary cam along said substantially radial direction with respect to said axis of the needle cylinder;

wherein said second actuation means comprise a second electric motor, which is supported by a fixed structure and is provided with an output shaft with a second actuation cam keyed thereon, said second actuation cam having coupled thereto a pair of cam followers, which are connected to said lower ring of the sinker cover to which said second actuation cam is coupled, said pair of cam followers being arranged so as to provide a bilateral and preloadable coupling to the profile of said second actuation cam.

14. The machine according to claim 13, wherein said upper zing supports said cam and said at least one complementary cam; said complementary cam being movable with respect to said upper ring along said substantially radial direction with respect to the axis of the needle cylinder; said lower ring being arranged in a downward region and coaxially with respect to said upper ring and having locators supported thereon, which face an opposite side of said complementary cam that is opposite with respect to a side that can engage the heel of the sinkers and are adapted to limit the movement of said complementary cam along said radial direction away from the axis of the needle cylinder.

15. The machine according to claim 13, comprising elastic means that contrast movement of said complementary cam away from the axis of the needle cylinder.

16. The machine according to claim 15, wherein said complementary cam has, on said opposite side thereof, a profile that can engage said locators and is shaped so as to vary a distance of said profile from said locators when an angular position of said lower ring with respect to said upper ring varies.

17. The machine according to claim 13, wherein said first actuation means comprise a first electric motor, supported by a fixed structure, said first electric motor being provided with an output shaft to which a first actuation cam is keyed, said actuation cam being coupled to at least one cam follower that is connected to said upper ring of the sinker cover.

18. The machine according to claim 17, comprising a pair of cam followers, said first actuation cam being coupled to said pair of cam followers, which are connected to said upper ring and are arranged so as to provide a bilateral and preloadable coupling with a profile of said first actuation cam.

19. The machine according to claim 18, wherein said first actuation cam and/or said second actuation cam are provided so as to rotate about an axis that is parallel to the axis of the needle cylinder.

20. The machine according to claim 19, wherein profile portions of said first actuation cam and/or of said second actuation cam are shaped complementarily and are coupled, respectively, to said pairs of cam followers.

21. The machine according to claim 17, wherein said first and second electric motor of the actuation means is constituted by a step motor.

22. The machine according to claim 20, comprising sensing means for sensing rotation of said first actuation earn and/or of said second actuation cam about axis thereof.

23. The machine according to claim 22, comprising sensing means for sensing rotation of said upper ring and/or of said lower ring of the sinker cover about the axis of the needle cylinder.

24. The machine according to claim 20, wherein the profile of said first actuation cam and/or of said second actuation cam is shaped so as to determine a linear relationship between a rotation of said first actuation cam and a rotation of said upper ring of the sinker cover and/or between a rotation of said second actuation cam and a rotation of said lower ring of the sinker cover.

* * * * *